US008069695B1

(12) United States Patent
Enneking et al.

(10) Patent No.: US 8,069,695 B1
(45) Date of Patent: Dec. 6, 2011

(54) WORK ROLL CLEANING SYSTEM AND METHOD OF CLEANING WORK ROLLS OF A MULTI-ROLL LEVELER

(75) Inventors: Tony Enneking, Minster, OH (US); Guil Bergman, St. Henry, OH (US); Dave Hamberg, Chickasaw, OH (US)

(73) Assignee: Machine Concepts, Inc., Minster, OH (US)

( * ) Notice: Subject to any disclaimer, the term of this patent is extended or adjusted under 35 U.S.C. 154(b) by 862 days.

(21) Appl. No.: 11/954,758

(22) Filed: Dec. 12, 2007

(51) Int. Cl.
*B21C 43/00* (2006.01)
*B21B 28/00* (2006.01)
*B21B 35/00* (2006.01)

(52) U.S. Cl. ..... 72/40; 72/236; 72/249; 72/160

(58) Field of Classification Search ..... 72/39, 40, 72/236, 249, 160; 15/3, 97.1
See application file for complete search history.

(56) References Cited

U.S. PATENT DOCUMENTS 6,857,301 B1 * 2/2005 Bergman et al. ..... 72/11.7

* cited by examiner

*Primary Examiner* — Debra M Sullivan
(74) *Attorney, Agent, or Firm* — Standley Law Group LLP

(57) ABSTRACT

A system and method for cleaning the work rolls of a multi-roll leveler. The system includes a roll cleaning drive system for driving one or both of a set of upper and lower work rolls against a cleaning pad placed therebetween. The roll cleaning drive system is disengageable with the work rolls to be driven thereby. The upper and lower work rolls are driven in opposite rotational directions so as not to eject the cleaning pad from the leveler. The rotational direction of the upper and lower work rolls may be periodically reversed to produce a scrubbing action on the work rolls.

25 Claims, 11 Drawing Sheets

WORK ROLL CLEANING SYSTEM AND METHOD OF CLEANING WORK ROLLS OF A MULTI-ROLL LEVELER

BACKGROUND OF THE INVENTIVE FIELD

The present invention is directed to a system and method for cleaning the work rolls of a multi-roll leveler. More particularly, the present invention is directed to a system and method for cleaning the work rolls of a multi-roll leveler by driving the work rolls against a cleaning pad.

Strip materials are used or produced in various industries. In at least certain of these industries, it is desired that a strip of material of interest have as flat a profile as possible. Unfortunately, it is also known that at least certain strip material manufacturing processes commonly impart one or more types of deformation to the strip materials produced thereby, which deformation tends to reduce the flatness of the strip materials. To that end, various devices, systems and techniques have been developed for both detecting and correcting the flatness of a moving strip of material.

While not limited thereto, a common use of such aforementioned flatness detecting and correcting devices, systems and techniques occurs in the production of strip metal products, wherein hot slabs or billets of steel and other metals are rolled into thin sheets. This hot-rolling process, as well as several devices, systems and techniques for detecting and/or correcting the flatness of sheet metal products produced thereby, is described in more detail in U.S. Pat. No. 6,857,301 (the '301 patent) to Bergman et al., which is hereby incorporated by reference herein.

The '301 patent specifically describes various embodiments of a microprocessor-controlled multi-roll leveler capable of automatically correcting for shape defects in metal strip materials. This and other multi-roll levelers generally employ opposing, substantially parallel sets of work rolls that are typically supported by back-up rolls. During operation, the metal strip material is fed into the entrance of the leveler, such as from a coil, and is caused to pass between the opposing sets of work rolls. Each set of work rolls is placed into contact with the metal strip, such as by driving one set of work rolls toward the other, so that a leveling (flattening) force is impressed upon the metal strip as it passes therebetween. The work rolls operate to relieve stresses induced by the hot rolling process, and to thereby impart flatness across the entire width of the strip.

Unfortunately, materials such as the metal strip materials commonly operated on by such levelers, may often carry various contaminants on the exposed surfaces thereof. These contaminants may include, for example, oxide from aluminum, rust, various coating materials, oil, and general dirt and dust. As the leveler rolls contact and act on these contaminated materials, some of the contaminants are transferred to the rolls. Over time, a build-up of such contaminants may accumulate on the work rolls. This typically requires that the work rolls be cleaned in order to permit continued proper operation of the leveler and/or to ensure that the presence of the contaminants between the work rolls and the material being leveled does not mark or otherwise mar the material surface.

Known work roll cleaning techniques have proven less than satisfactory, whether due to the inefficient method by which they are conducted or the inadequate results obtained thereby. For example, certain known roll cleaning techniques employ a cleaning element that is placed between a set of rotating upper and lower leveler work rolls. Unfortunately, the cleaning element must be secured in some manner to prevent its continual ejection from between the work rolls. A roll cleaning system and method of the present invention overcomes the deficiencies of known work roll cleaning systems and methods.

SUMMARY OF THE GENERAL INVENTIVE CONCEPT

The present invention provides a quick and effective system and method by which leveler work roll cleanliness can be achieved and maintained. Generally, a system and method of the present invention includes a cleaning pad that is placed between the upper and lower work rolls of a multi-roll leveler, whereafter the upper and lower work rolls are placed in contact with and rotationally driven against the cleaning pad.

The upper and lower work rolls may be rotationally driven against the cleaning pad in a number of ways, exemplary embodiments of which are described in more detail below. In any event, the upper and lower work rolls are preferably driven in the same rotational direction, such that the position of the unsecured cleaning pad within the leveler is substantially maintained during the work roll cleaning process. Preferably, but not essentially, the direction of rotation of both sets of work rolls is periodically reversed during the cleaning operation. This has been shown to produce a scrubbing effect that hastens and enhances the cleaning of the work rolls.

Preferably, the leveler controller includes, or is provided with, the ability to control the work roll cleaning operation. This control functionality may be made inherent to new levelers, and/or the control systems of existing levelers may be modified to provide such functionality. Alternatively, a separate controller may be provided to control the work roll cleaning operation, which controller may or may not communicate with the leveler controller.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
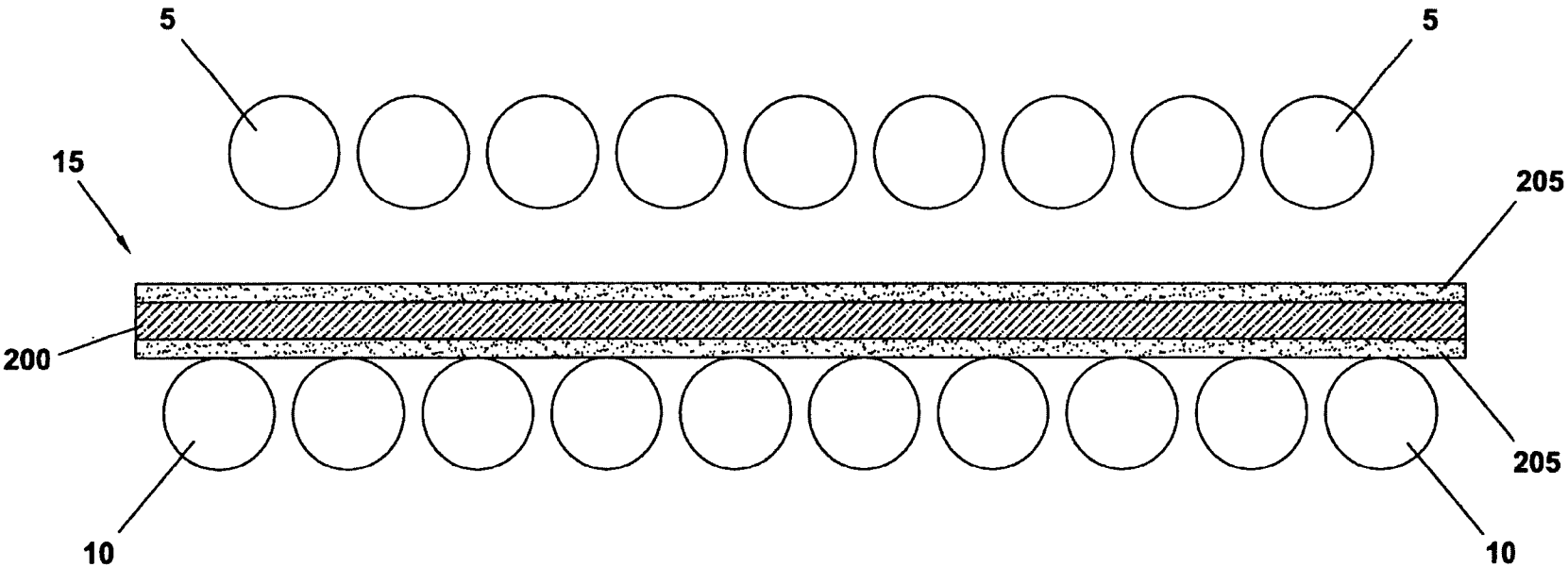
FIG. 1 schematically illustrates a cleaning pad of the present invention located between open upper and lower work rolls of a multi-roll leveler.
Figure 2:
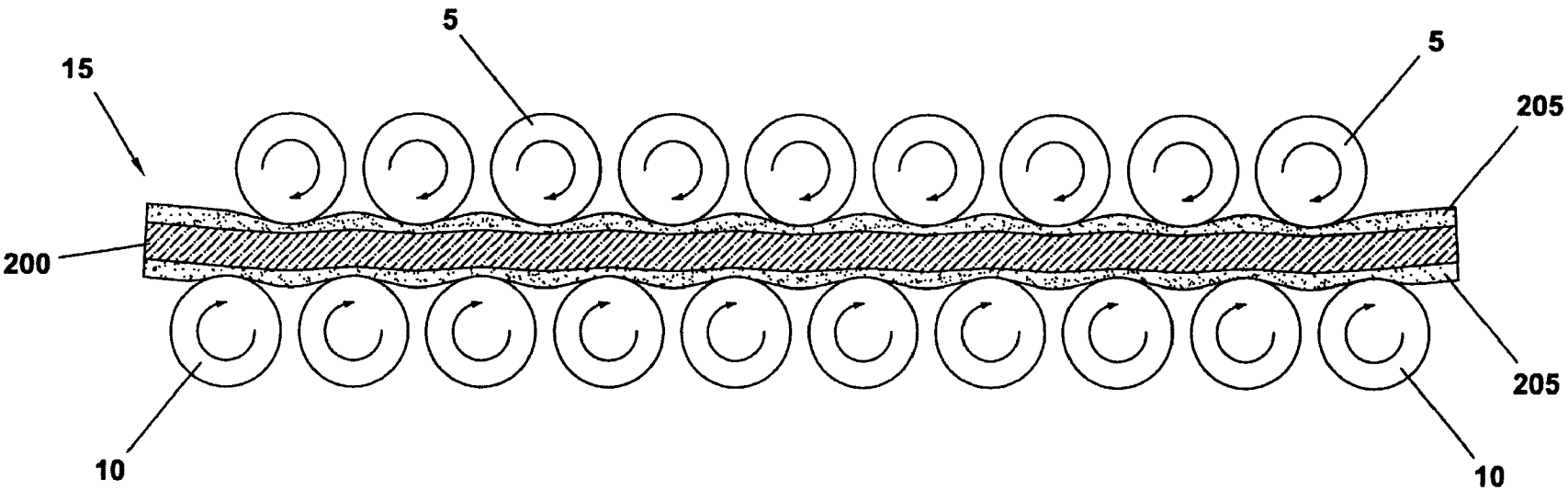
FIG. 2 shows the upper and lower work rolls of FIG. 1 in contact with and being driven against the cleaning pad.

The general work roll cleaning concept of the present invention is schematically illustrated in FIGS. 1-2. A leveler is shown to includes upper work rolls, 5 and lower work rolls 10. As shown, the work rolls 5, 10 are in an open or non-cleaning position. With the work rolls 5, 10 in an open position, a cleaning pad 15 is placed in the leveler so as to rest on the lower work rolls.

With the cleaning pad 15 so positioned, the work rolls 5, 10 are moved to a cleaning position, as illustrated in FIG. 2. More specifically, one or both sets of work rolls 5, 10 is/are moved such that the work rolls are in contact with the cleaning pad 15. Preferably, the work rolls 5, 10 cause a slight compression of the cleaning pad 15, as shown in FIG. 2. This slight compression of the cleaning pad 15 helps to ensure that there is sufficient contact between the cleaning pad and the work rolls 5, 10 to effectuate adequate cleaning thereof.

Preferably, the upper work rolls 5 and the lower work rolls 10 are rotationally driven in the same direction (see FIG. 2) and at substantially the same speed. Consequently, the contact forces exerted on the cleaning pad 15 by the work rolls 5, 10 are oppositely directed, and the cleaning pad is thus maintained in a substantially stationary position within the leveler despite its contact with the rotating work rolls.

It is also preferred, but not essential, that the direction of rotation of the upper and lower work rolls 5, 10 be periodically reversed. Preferably, reversal of the direction of rotation occurs substantially simultaneously as to both the upper and lower work rolls 5, 10, such that the direction of rotation of one set of work rolls remains the same as that of the other set of work rolls. This prevents the cleaning pad 15 from being incrementally driven out from between the work rolls 5, 10.

One exemplary embodiment of a work roll cleaning drive system (hereinafter "roll cleaning drive system") 20 of the present invention can be observed in FIGS. 3*a*-3*c*. As shown, the roll cleaning drive system 20 is associated with the lower work rolls 10. However, it should be understood that the roll cleaning drive system 20 may also be associated with the upper work rolls 5.

In this particular embodiment of the roll cleaning drive system 20, a motor 25 and serpentine belt 30 are used to rotationally drive the work rolls 10. The motor 25 may be connected to a speed reducer 35, as would be understood by one skilled in the art. As can be best observed by further reference to FIG. 4, wherein various drive system components have been removed or shown in partial transparency for clarity, the output of the speed reducer 35 is connected to a main drive pulley 40 that drives the serpentine belt 30. The serpentine belt 30 traces a circuitous path around a series of secondary drive pulleys 45 and a number of idler pulleys 50. A belt tensioner 55 may also be provided. It can be understood that all of the secondary drive pulleys 45 are rotated in the same direction by the serpentine drive belt 30.

As shown herein, there are five secondary drive pulleys 45 and corresponding drive gears 65, and four idler pulleys 50. However, as would clearly be understood by one skilled in the art, the number of secondary drive pulleys 45, drive gears 65 and idler pulleys 45 used will depend on the number of work rolls to be cleaned and the number of work rolls to be driven by each drive gear. As explained in more detail below, there are ten work rolls 10 of interest in this exemplary embodiment, two of which are driven by each drive gear 65. In other embodiments, a different number of work rolls may be present and/or each drive gear may drive a lesser or number of work rolls. Consequently, it can be understood that various numbers of secondary drive pulleys, idler pulleys and drive gears may be present in a given system of the present invention.

Figure 3A:
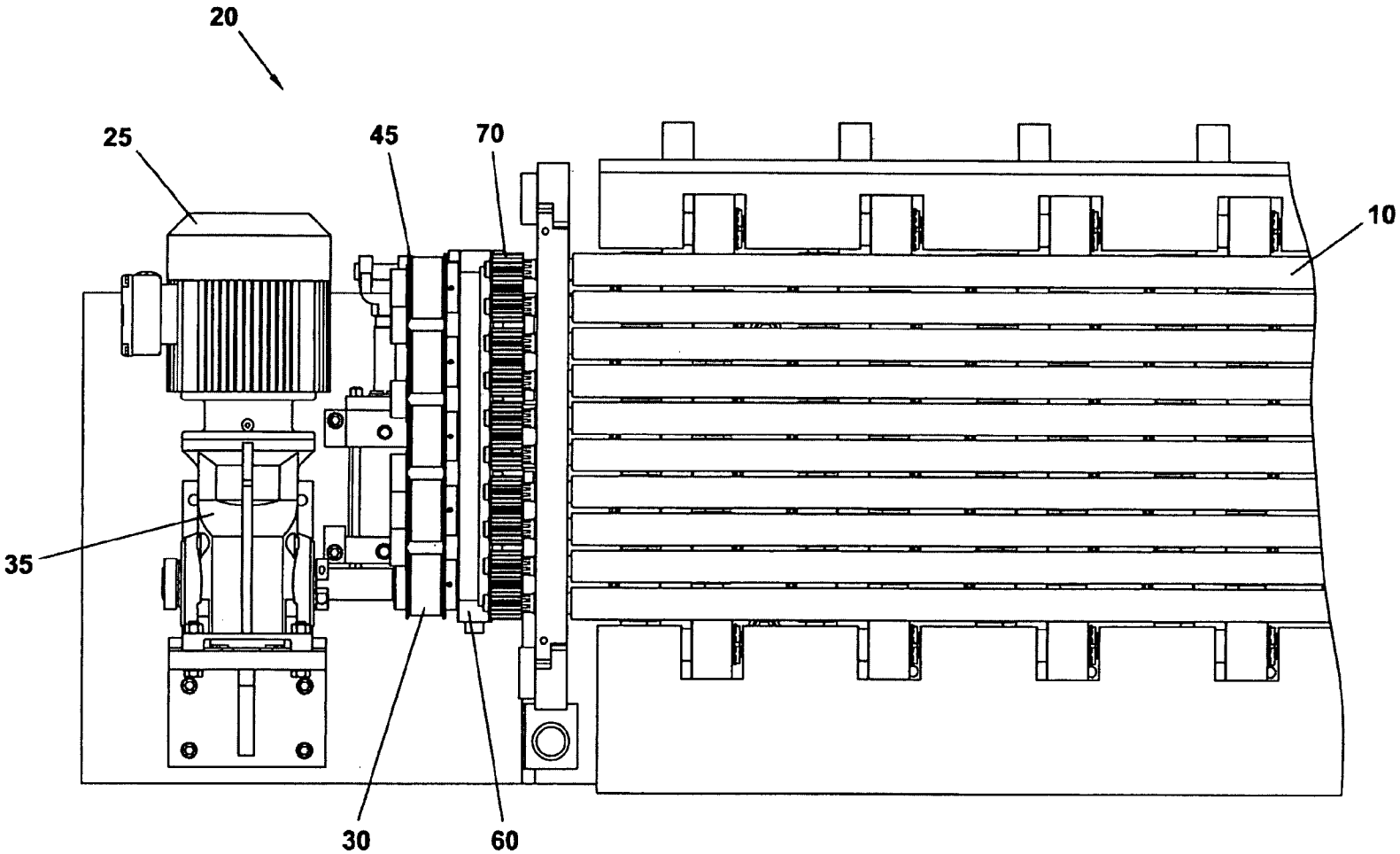
FIG. 3*a* is a top plan view showing one exemplary roll cleaning drive system for rotationally driving a set of leveler work rolls during a work roll cleaning operation of the present invention.
Figure 3B:
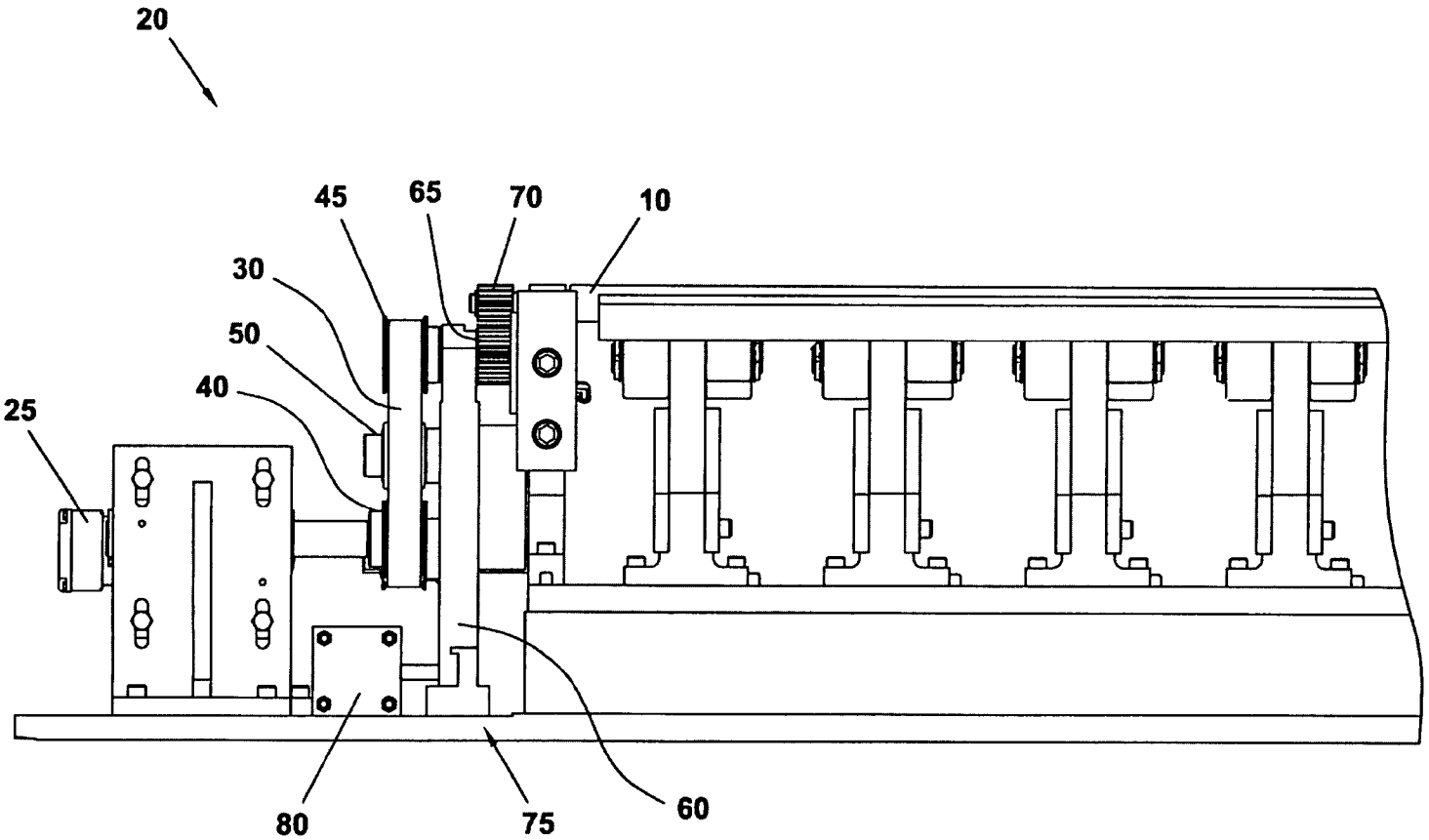
FIG. 3*b* is a side elevation view of the roll cleaning drive system of FIG. 3*a;*
Figure 3C:
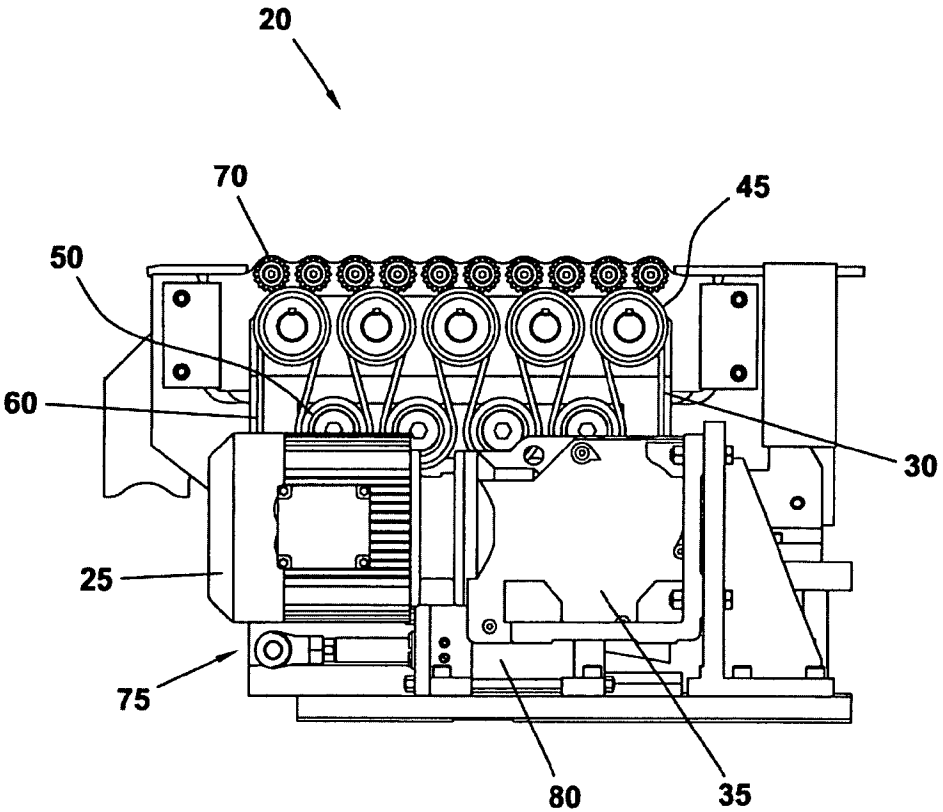
FIG. 3*c* is a front elevation view of the roll cleaning drive system of FIG. 3*a;*

As can be best observed in FIGS. 3*a*-3*c*, the main drive pulley 40, secondary drive pulleys 45 and idler pulleys 50 of this particular embodiment are associated with a bearing block 60. The secondary drive pulleys 45 are also connected to corresponding drive gears 65 that reside on an opposite side of the bearing block 60.

In this embodiment, each work roll 10 has a pinion gear 70 connected to at least one end of thereof. The driving assembly 120 of the motor 25, bearing block 60, pulleys 45, 50, serpentine belt 30 and drive gears 65 are located such that the drive gears are aligned with and are preferably in close proximity to the pinion gears 70.

At least the bearing block 60 (and its associated pulleys 45, 50 and drive gears 65) is adapted for vertical movement. Alternatively, the entire driving assembly 120 may be adapted for vertical movement. In this particular embodiment, vertical movement is achieved by controlled displacement of an interconnected wedge assembly 75. Such an interconnected wedge assembly 75 would be understood by one skilled in the art. Nonetheless, an exemplary embodiment of such a wedge assembly 75 is depicted in FIG. 5.

Figure 5:
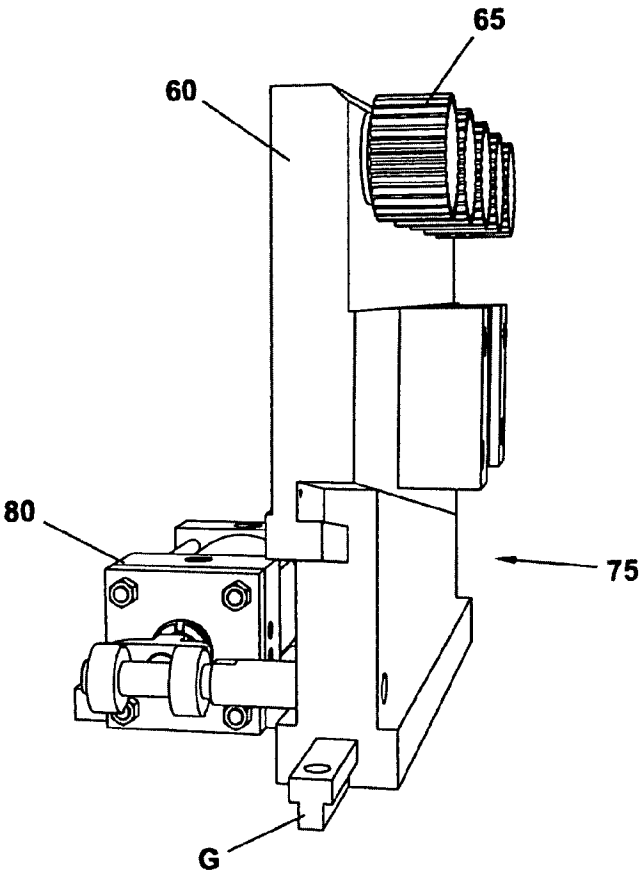
FIG. 5 is a perspective view depicting an exemplary wedge assembly that can be used to produce engagement of a roll cleaning drive system of the present invention.

As shown in FIG. 5, displacement of the wedge assembly 75 is accomplished in this embodiment by an actuator, particular a linear actuator 80. The linear actuator 80 may be, for example, a pneumatic cylinder or a hydraulic or electric actuator of various designs. The linear actuator 80 causes a sliding movement of the wedge assembly 75, that results in a change in the height thereof. A guide rail G or some other linear guide mechanism may be provided to help direct the linear movement of the wedge assembly 75.

Figure 4:
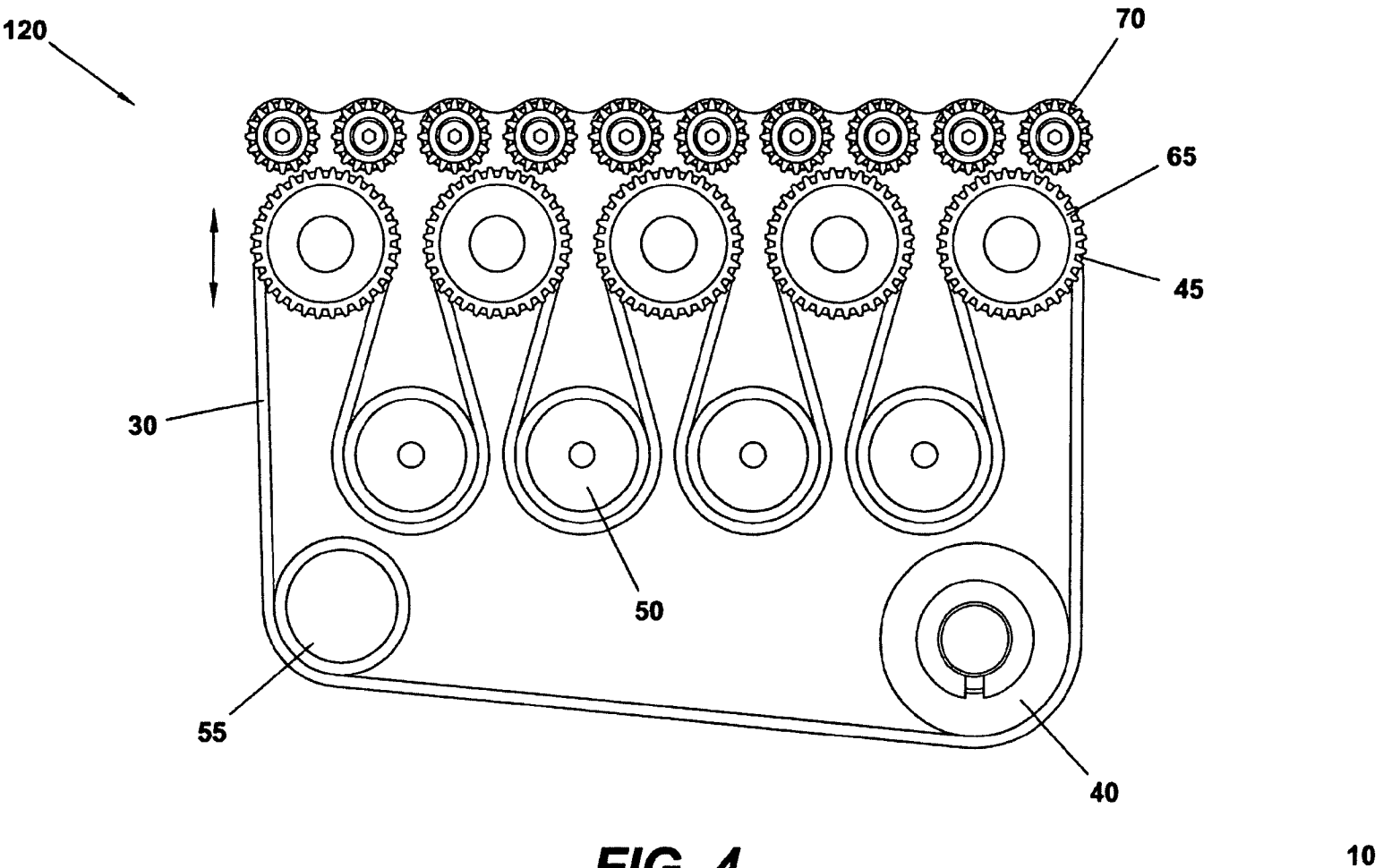
FIG. 4 schematically illustrates a driven portion of the roll cleaning drive system of FIGS. 3*a*-3*b*, with various components thereof removed or shown in partial transparency for clarity.

As shown in FIG. 4, the driving assembly 120 resides in a lowered (non-engaging) position when no roll cleaning operation is being performed. When a roll cleaning operation is initiated, however, the linear actuator 80 displaces the interconnected wedge assembly 75, thereby causing an increase in the elevation of that portion of the driving assembly 120 associated therewith. For example, in this particular embodiment, the wedge assembly 75 elevates the bearing block 60 and, thus, the drive gears 65 that are connected thereto. The drive gears 65 are elevated to a position in which they become engaged with the pinion gears 70 on the corresponding work rolls 10.

As such, with the drive gears 65 and pinion gears 70 engaged, rotation of the drive gears by the secondary drive pulleys 45 is transferred to the pinion gears 70 and their associated work rolls 10. The work rolls are thus rotationally driven in the opposite direction of the drive gears 65 during the roll cleaning operation. As mentioned above, the rotational direction of the work rolls 10 may be periodically reversed during the roll cleaning process, such as by reversing the rotational direction of the motor 25 or the speed reducer 30.

Figure 6:
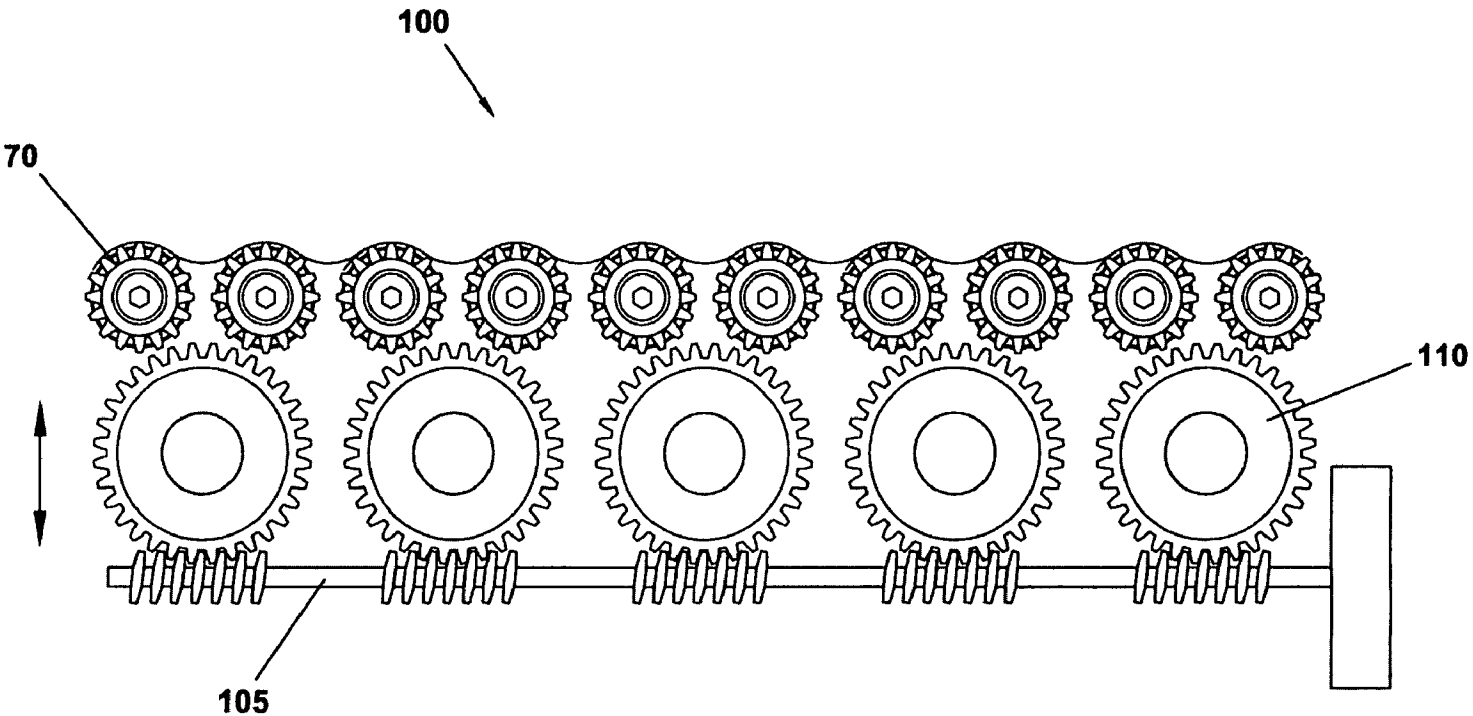
FIG. 6 schematically illustrates an alternative exemplary embodiment of a driven portion of a roll cleaning drive system that can be used in place of the driven portion of FIG. 4.

An alternate embodiment 100 of the roll cleaning drive system 20 of FIGS. 3*a*-4 is schematically represented in FIG. 6, wherein various drive system components have again been removed for clarity. In this embodiment of the roll cleaning drive system 100, the secondary drive pulleys 45 and idler pulleys 50 are replaced with a worm gear 105 that directly rotates a set of drive gears 110. The drive gears 110 may be the same as the drive gears 65 of the previous roll cleaning drive system embodiment 20, and are again designed to mesh with and engage the pinion gears 70 of the work rolls 10. The drive gears 65 may again be engaged/disengaged with/from the pinion gears 70 by the elevation technique described above. The worm gear 105 may be motor-driven using a belt connected to a pulley, using a corresponding drive gear, or by any other techniques that would be known to those skilled in the art. The worm gear may be mounted to, for example, a bearing block or another element that supports and retains the drive gears 110. A speed reducer may also be used.

Figure 7A:
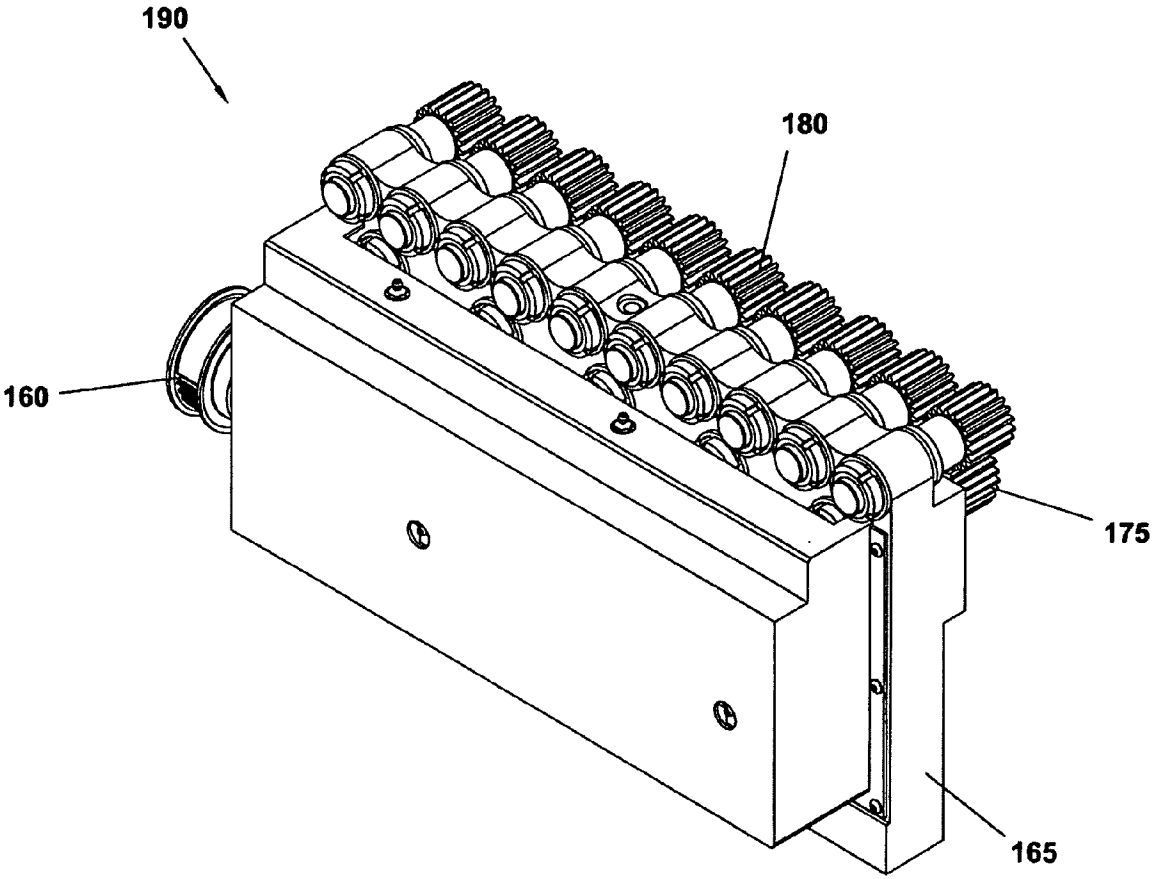
FIG. 7*a* is a perspective view of a driving assembly of an alternate embodiment of a roll cleaning drive system for rotationally driving a set of leveler work rolls during a work roll cleaning operation of the present invention.
Figure 7B:
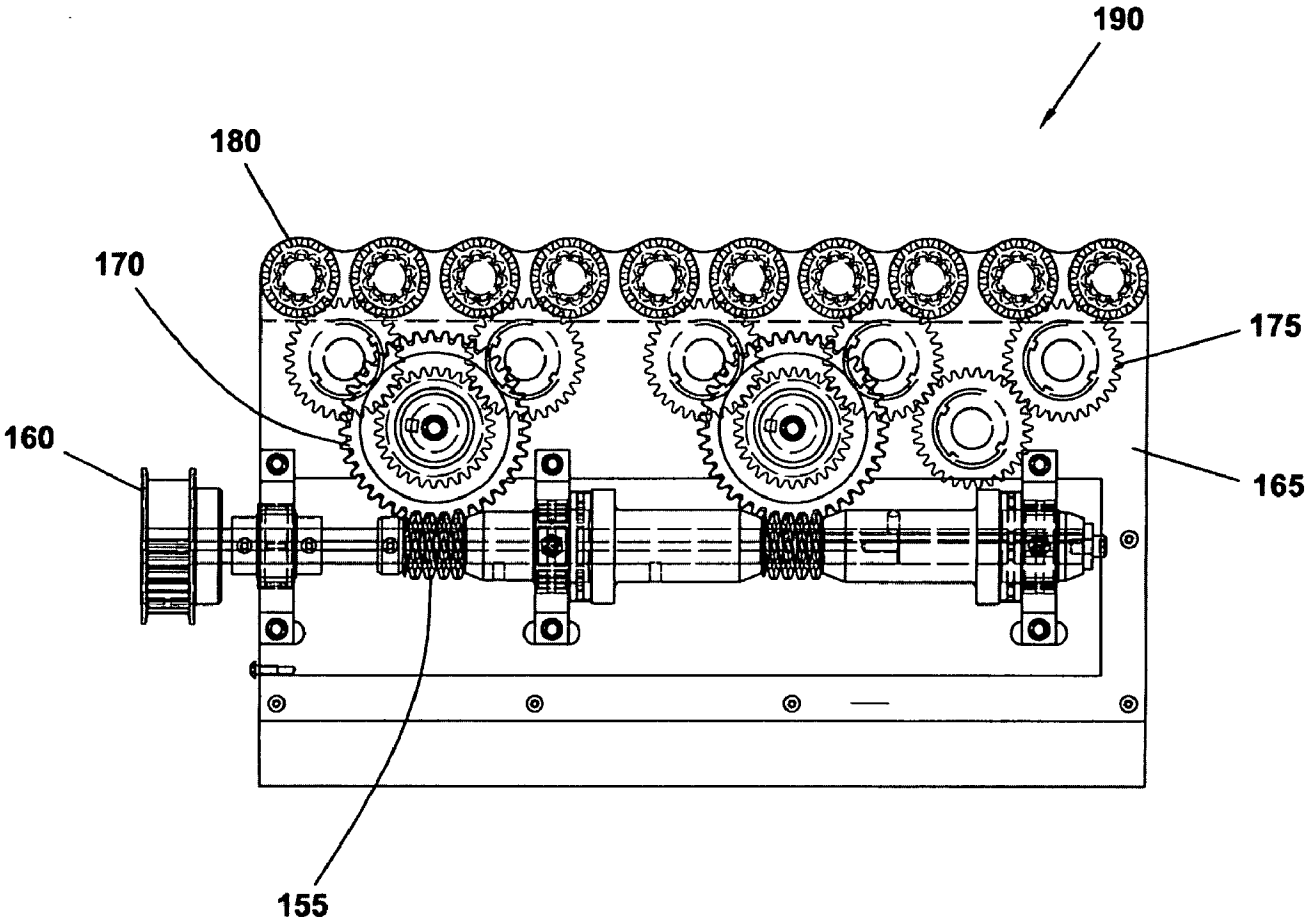
FIG. 7*b* is a front elevation view of the roll cleaning driving assembly of FIG. 7*a*.

A variation of this drive mechanism can be observed in FIG. 7*b*. In this variation, a worm gear drives a pair (in this case) of primary drive gears, which in turn drive a number of secondary drive gears that are engageable with the pinion gears. Other variations are obviously also possible, and such variations are considered to fall within the scope of the present invention.

Figure 7C:
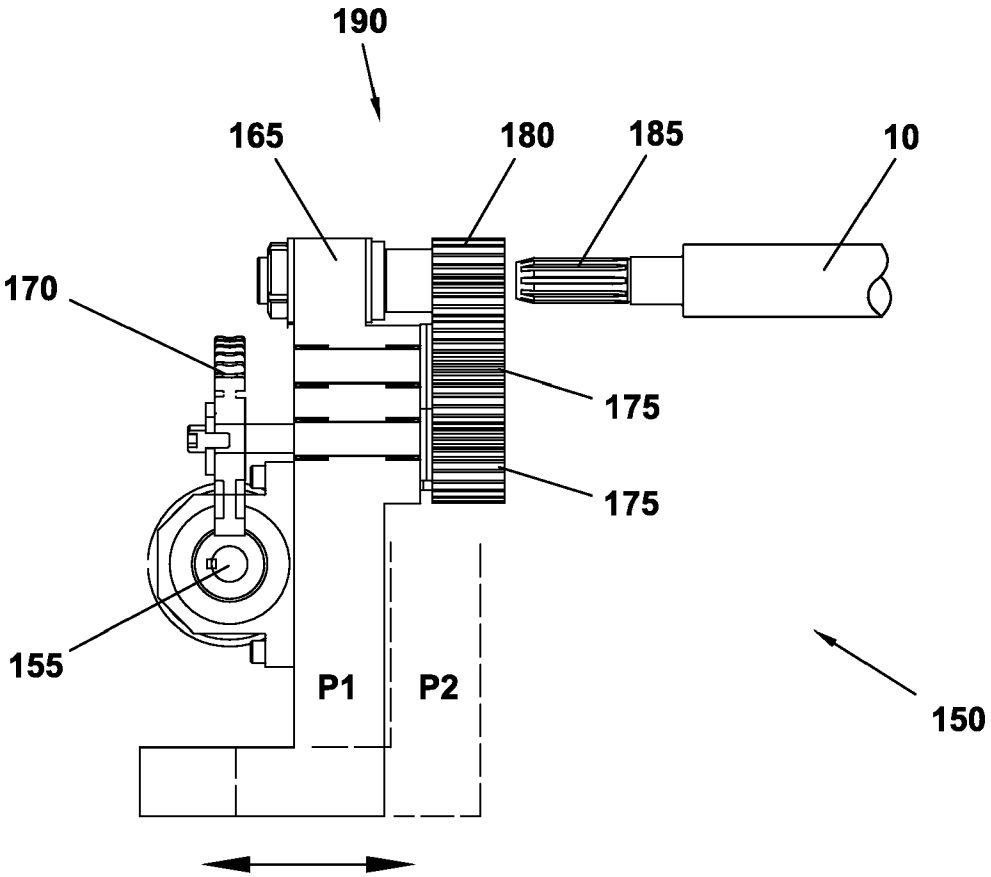
FIG. 7*c* is a side elevation view of the roll cleaning drive system referenced in FIG. 7*a*.

Yet another embodiment of a roll cleaning drive system 150 of the present invention is shown in FIG. 7*c*. Primarily, this roll cleaning drive system 150 is designed for sliding engagement with a set of corresponding work rolls. As with the roll cleaning drive system 20 described above, it should be understood that the roll cleaning drive system 150 can be associated with the upper and/or lower work rolls 5, 10. In this example, however, the roll cleaning drive system is shown to operate only with the lower work rolls 10.

As shown most clearly in FIGS. 7*a*-7*b*, the roll cleaning drive system 150 includes a driving assembly 190 having worm gear 155 that is connected to a drive pulley 160. The drive pulley may be connected to a motor (not shown for clarity), such as the motor 25 described above. A speed reducer may or may not be interposed between the motor and the drive pulley 160. The worm gear 155 is mounted to one side of a bearing block 165, as are a pair (in this case) of primary drive gears 170.

The primary drive gears 170 are engaged (continuously in this case) to a number of secondary drive gears 175 located on the opposite side of the bearing block 165. The secondary drive gears are, in turn, engaged with a number of externally geared work roll receivers 180, which are rotated thereby in the same direction as that of the primary drive gears 170. The work roll receivers 180 each receive and accordingly rotate a corresponding work roll 10.

As discussed above with regard to the roll cleaning drive system 20, the number of drive components used in a driving assembly of a roll cleaning drive system like that shown in FIGS. 7*a*-7*c* will depend on the number of work rolls to be driven and the exact gear arrangement selected. As shown, there are two primary drive gears 170, six secondary drive gears 175, and ten work roll receivers 180—which rotate ten work rolls 10. In other embodiments, a different number of work rolls and/or primary and secondary drive gears may be present.

In a manner similar to that of the roll cleaning drive system 20, the driving assembly 190 is generally disengaged from the work rolls 10 unless a roll cleaning operation is to be performed. Unlike the roll cleaning drive system 20, however, engagement and disengagement of the driving assembly 190 with the work rolls 10 is accomplished by sliding the driving assembly back-and-forth along the axial centerline of the work rolls 10 (as indicated by the arrows in FIG. 7*c*). Sliding of the driving assembly can be accomplished in a variety of ways that would be apparent to one skilled in the art. For example, a linear actuator may be used for this purpose. The driving assembly 190 may be coupled to a guide rail(s) or some other linear guide system that facilitates proper sliding thereof.

The work roll receivers 180 and a corresponding end of each work roll 10 to be driven thereby are adapted for splined engagement. As shown in FIG. 7*c*, each work roll 10 to be driven is provided with a splined end 185 that is received in a like-splined receptacle (not shown) within a corresponding work roll receiver 180. This allows the driving assembly 190 to be slidably engaged with the work rolls 10, while also ensuring that sufficient engagement between the work roll receivers 180 and the work rolls 10 exists to produce rotation of the work rolls against the resistance of the cleaning pad 15.

Each of the exemplary roll cleaning drive systems discussed above and shown in the drawing figures, is designed to engage and rotate a free-spinning set of upper and/or lower leveler work rolls. In the particular embodiments shown, the roll cleaning drive systems are provided to engage a set of lower work rolls. Based on various leveler designs, however, one skilled in the art would understand that other arrangements are also possible.

In certain embodiments of the present invention, separate roll cleaning drive systems may be used to drive a set of lower work rolls and a set of upper work rolls. In such a case, two separate roll cleaning drive systems (such as, but not limited to, those shown and described herein) may be employed, one drive system associated with each set of work rolls. Alternatively, a roll cleaning drive system of the present invention may be designed such that one motor can drive both an upper and lower set of work rolls in a like direction. For example, a pinion box with one motor input and two output shafts may be employed for this purpose. Universal joints may be provided to accommodate the positional changes of the work rolls occurring when the leveler is moved between an open vs. closed (or cleaning) position.

As would be understood by one skilled in the art, multi-roll levelers may have one set of work rolls that is always engaged with a work roll drive system of the leveler, which drive system is used to drive the set of work rolls during the leveling process. In such a case, this work roll drive system may drive one set of work rolls during a work roll cleaning operation, while the other (free-spinning) set of work rolls may be driven in a like rotational direction by a roll cleaning drive system of the present invention. Such an embodiment is possible regardless of whether the free-spinning work rolls comprise the upper or lower work rolls of a given leveler.

The general nature of one embodiment of a cleaning pad of the present invention can be understood by referring back to FIGS. 1-2. Although cleaning pads of various material and construction may be employed in the present invention, such a cleaning pad preferably, but not essentially, exhibits sufficient stiffness to provide pressure against the work rolls while simultaneously exhibiting sufficient flexibility to wrap slightly around the work rolls during a cleaning operation (see FIG. 2). It has been found that this combination of cleaning pad characteristics enhances the ability of a cleaning pad to clean the work rolls.

These aforementioned cleaning pad characteristics may be achieved in a number of ways. For example, the particular cleaning pad 15 depicted in FIGS. 1-2 is of a composite design. More particularly, the cleaning pad includes a core 200 having an abrasive material 205 affixed to opposite sides thereof. The abrasive material 205 may be permanently or removably attached to the core 200. During a work roll cleaning operation, the abrasive material 205 contacts the work rolls 5, 10.

The core 200 may be comprised of various materials. For example, and without limitation, the core 200 may be comprised of materials such as plywood, plastic foam, or felt. In one exemplary embodiment of a cleaning pad, good test results were obtained when using a core material comprised of dense felt having a thickness of approximately ½ inch. Of course, a multitude of other core materials may also be used as long as the resulting cleaning pad provides for acceptable cleaning of the work rolls. As such, it is to be understood that a composite cleaning pad of the present invention is not limited to any particular core material.

As with the core 200, various abrasive materials 205 may also be used in a cleaning pad for use with the present invention. Certain multi-roll levelers are used for non-surface critical applications, such as the processing of hot rolled steel. In such a case, the work rolls are not required to have a particularly fine finish, and a slight scratching of the work rolls will not be detrimental to the leveling process. Consequently, a more aggressive abrasive material may be used in such a case.

Contrarily, certain multi-roll levelers are used to process highly surface-critical materials. In these applications, even fine scratches on the work rolls could mark or otherwise mar the material being leveled. Consequently, a finer, less aggressive, abrasive may be used in such a case so as to avoid scratching the work rolls.

The particular abrasive material(s) used in a cleaning pad of the present invention may include, without limitation, emery cloth type pads with various abrasive levels (grits) and non-woven cleaning pads (such as Scotch-Brite™ pads) having various abrasive levels. As with the core, a number of other abrasive materials may also be used as long as the resulting cleaning pad provides for acceptable cleaning of the work rolls. As such, it is to be understood that a composite cleaning pad of the present invention is not limited to any particular abrasive material.

A cleaning pad of the present invention is also not limited to a composite construction. Rather, as would be understood by one skilled in the art, it is possible to construct a cleaning pad from a single material. For example, a cleaning pad comprised solely of a sheet of abrasive material of some thickness may be used. As with the composite pad, it is to be understood that such a cleaning pad is not limited to any particular abrasive material or to any particular sheet thickness. Any cleaning pad of the present invention may be disposable or reusable in nature.

While certain embodiments of the present invention are described in detail above, the scope of the invention is not to be considered limited by such disclosure, and modifications are possible without departing from the spirit of the invention as evidenced by the following claims.

What is claimed is:

1. A system for cleaning the work rolls of a multi-roll leveler, comprising:

a cleaning pad for contacting placement between sets of upper and lower work rolls of said leveler;

a roll cleaning drive system for causing rotation of at least one of said upper and lower sets of work rolls; and an engaging mechanism for engaging said roll cleaning drive system with said at least one of said upper and lower sets of work rolls during a work roll cleaning operation, and for disengaging said drive system therefrom subsequent to completion of said work roll cleaning operation;

wherein said upper work rolls and said lower work rolls are driven in the same rotational direction so as to exert oppositely directed contact forces against said cleaning pad during said work roll cleaning operation.

2. The system of claim 1, wherein said roll cleaning drive system drives said upper work rolls and said lower work rolls.

3. The system of claim 2, wherein a separate roll cleaning drive system is associated with said upper work rolls and said lower work rolls.

4. The system of claim 2, wherein a single roll cleaning drive system drives said upper work rolls and said lower work rolls.

5. The system of claim 1, wherein said roll cleaning drive system drives one of said set of upper work rolls and said set of lower work rolls, while the other set of work rolls is driven by a work roll drive system used to drive said set of work rolls during a leveling operation.

6. The system of claim 1, wherein said roll cleaning drive system includes a plurality of belt-driven pulleys that rotate a set of drive gears, said drive gears adapted to correspondingly rotate an associated set of work rolls via engagement with a pinion gear attached to an end of each work roll.

7. The system of claim 1, wherein said roll cleaning drive system includes a worm gear that rotates a set of drive gears, said drive gears adapted to correspondingly rotate an associated set of work rolls via engagement with a pinion gear attached to an end of each work roll.

8. The system of claim 1, wherein said roll cleaning drive system includes a plurality of rotationally-driven work roll receivers, said work roll receivers having a splined cavity for receiving a like-splined end of a corresponding work roll to be driven.

9. The system of claim 1, wherein said roll cleaning drive system is designed to be engaged with said work rolls by elevating at least a portion of said drive system.

10. The system of claim 1, wherein said roll cleaning drive system is designed to be engaged with said work rolls by sliding at least a portion of said drive system along the axial centerlines of the associated work rolls.

11. The system of claim 1, wherein said roll cleaning drive system is adapted to periodically reverse the rotational direction of said upper and lower work rolls during a cleaning operation.

12. The system of claim 1, wherein said cleaning pad is a composite pad having a core material covered on at least two sides by an abrasive material.

13. A system for cleaning the work rolls of a multi-roll leveler, comprising:

a cleaning pad for contacting placement between a set of normally driven upper work rolls and a set of normally free-spinning lower work rolls of said leveler;

a normally engaged work roll drive system for producing rotation of said set of upper work rolls;

a disengageable and reversible roll cleaning drive system for producing rotation of said set of lower work rolls, said rotation of said lower work rolls being in the same direction as that of said upper work rolls; and an engaging mechanism for engaging said roll cleaning drive system with said set of lower work rolls during a work roll cleaning operation, and for disengaging said roll cleaning drive system therefrom subsequent to completion of said work roll cleaning operation;

wherein said upper work rolls and said lower work rolls are driven against said cleaning pad during said work roll cleaning operation.

14. The system of claim 13, wherein said roll cleaning drive system includes a plurality of belt-driven pulleys that rotate a set of drive gears, said drive gears adapted to correspondingly rotate said set of lower work rolls via engagement with a pinion gear attached to an end of each lower work roll.

15. The system of claim 13, wherein said roll cleaning drive system includes a worm gear that rotates a set of drive gears, said drive gears adapted to correspondingly rotate said set of lower work rolls via engagement with a pinion gear attached to an end of each lower work roll.

16. The system of claim 13, wherein said roll cleaning drive system includes a plurality of rotationally-driven work roll receivers, said work roll receivers having a splined cavity for receiving a like-splined end of a corresponding lower work roll to be driven.

17. The system of claim 13, wherein said roll cleaning drive system is designed to be engaged with said lower work rolls by elevating at least a portion of said drive system.

18. The system of claim 13, wherein said roll cleaning drive system is designed to be engaged with said lower work rolls by sliding at least a portion of the drive system along the axial centerline of said lower work rolls.

19. The system of claim 13, wherein said roll cleaning drive system and said normally engaged work roll drive system are adapted to periodically reverse the rotational direction of their associated work rolls during a cleaning operation.

20. The system of claim 13, wherein said cleaning pad is a composite pad having a core material covered on at least two sides by an abrasive material.

21. A method of cleaning the work rolls of a multi-roll leveler, comprising:

placing a cleaning pad between a set of normally driven upper work rolls and a set of normally free-spinning lower work rolls of said leveler;

providing a means for rotating said upper work rolls and said lower work rolls, said means further comprising:

a normally engaged work roll drive system for producing rotation of said set of upper work rolls, a disengageable and reversible roll cleaning drive system for producing rotation of said set of lower work rolls, and an engaging mechanism for engaging said roll cleaning drive system with said set of lower work rolls during a work roll cleaning operation, and for disengaging said roll cleaning drive system therefrom subsequent to completion of said work roll cleaning operation, moving said work rolls into a cleaning position wherein both sets of work rolls are in contact with said cleaning pad;

activating said engaging mechanism to engage said roll cleaning drive system with said lower said of work rolls;

operating said normally engaged work roll drive system to rotate said set of upper work rolls against said cleaning pad in a first direction;

simultaneously operating said roll cleaning drive system to rotate said set of lower work rolls against said cleaning pad in said first direction;

upon sufficient cleaning of said work rolls, terminating rotation of said upper and lower work rolls, and removing said cleaning pad from said leveler; and disengaging said roll cleaning drive system from said set of lower work rolls.

22. The method of claim 21, further comprising periodically and substantially simultaneously reversing the rotational direction of said upper and lower work rolls.

23. The method of claim 22, wherein reversal of the rotational direction of said work rolls occurs while said work rolls are in said cleaning position.

24. The method of claim 21, wherein said roll cleaning drive system is engaged with said set of lower work rolls by using said engaging mechanism to elevate at least a portion of said roll cleaning drive system.

25. The system of claim 21, wherein said roll cleaning drive system is engaged with said set of lower work rolls by using said engaging mechanism to slide at least a portion of said roll cleaning drive system along the axial centerlines of said lower work rolls.

* * * * *